US011022363B2

(12) United States Patent
Lee et al.

(10) Patent No.: US 11,022,363 B2
(45) Date of Patent: Jun. 1, 2021

(54) REFRIGERATOR AND CONTROL METHOD THEREFOR

(71) Applicant: LG Electronics Inc., Seoul (KR)

(72) Inventors: Donghyoung Lee, Seoul (KR); Kihwang Kim, Seoul (KR); Daesig Shin, Seoul (KR); Sunghee Kang, Seoul (KR); Yonghyeon Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/329,960

(22) PCT Filed: Dec. 6, 2017

(86) PCT No.: PCT/KR2017/014218
§ 371 (c)(1),
(2) Date: Mar. 4, 2019

(87) PCT Pub. No.: WO2018/135749
PCT Pub. Date: Jul. 26, 2018

(65) Prior Publication Data

US 2019/0331393 A1 Oct. 31, 2019

(30) Foreign Application Priority Data

Jan. 19, 2017 (KR) ..... 10-2017-0009315

(51) Int. Cl.
*F25D 17/04* (2006.01)
*F25D 17/06* (2006.01)
*F25D 29/00* (2006.01)

(52) U.S. Cl.
CPC ..... *F25D 17/045* (2013.01); *F25D 17/067* (2013.01); *F25D 29/00* (2013.01);
(Continued)

(58) Field of Classification Search
CPC ..... F25D 17/067; F25D 29/00; F25D 2317/0666; F25D 2600/02; F25D 2700/12;
(Continued)

(56) References Cited

FOREIGN PATENT DOCUMENTS

JP 2003322446 11/2003
JP 4969674 7/2012
(Continued)

OTHER PUBLICATIONS

Extended European Search Report in European Application No. 17892885.9, dated Dec. 6, 2019, 9 pages.
(Continued)

*Primary Examiner* — Ana M Vazquez
(74) *Attorney, Agent, or Firm* — Fish & Richardson P.C.

(57) ABSTRACT

Disclosed is a refrigerator including a main body forming a refrigerating chamber and a freezing chamber each including a temperature sensor, a cooling unit having a compressor and an evaporator accommodated inside the main body and driven to circulate a refrigerant in the compressor and the evaporator to generate cold air around the evaporator, a fan positioned inside the main body to supply the cold air to the freezing chamber, a damper positioned between the freezing chamber and the refrigerating chamber and opened and closed to allow the freezing chamber and the refrigerating chamber to selectively communicate with each other, and a controller controlling the damper for a predetermined damper opening time when a temperature of the freezing chamber reaches a freezing satisfaction temperature according to driving of the cooling unit. A temperature change of the refrigerating chamber over time may be reduced and power consumption may be improved.

16 Claims, 7 Drawing Sheets

(52) U.S. Cl.
CPC .. *F25D 2317/0666* (2013.01); *F25D 2600/02* (2013.01); *F25D 2700/12* (2013.01)

(58) Field of Classification Search
CPC .... F25D 11/02; F25D 17/065; F25D 2600/06; F25D 17/045; F25D 19/00
See application file for complete search history.

(56) References Cited

FOREIGN PATENT DOCUMENTS

| | | | | |
|---|---|---|---|---|
| KR | 1019940004298 | | | 3/1994 |
| KR | 1019940020073 | | | 9/1994 |
| KR | 1020040013157 | | | 2/2004 |
| KR | 1020060032479 | | | 4/2006 |
| KR | 1020100056127 | | | 5/2010 |
| KR | 20110027562 | A | * | 3/2011 |
| KR | 1020110027562 | | | 3/2011 |
| WO | WO2015176581 | | | 11/2015 |

OTHER PUBLICATIONS

European Office Action in European Application No. 17892885.9, dated Sep. 16, 2020, 6 pages.
Indian Office Action in Indian Application No. 201817043087, dated Sep. 28, 2020, 5 pages (with English translation).

* cited by examiner

REFRIGERATOR AND CONTROL METHOD THEREFOR

CROSS-REFERENCE TO RELATED APPLICATIONS

This application is a National Stage application under 35 U.S.C. § 371 of International Application No. PCT/KR2017/014218, filed on Dec. 6, 2017, which claims the benefit of Korean Application No. 10-2017-0009315, filed on Jan. 19, 2017. The disclosures of the prior applications are incorporated by reference in their entirety.

TECHNICAL FIELD

The present disclosure relates to a refrigerator operated to maintain a space for storing food at a predetermined temperature.

BACKGROUND ART

A refrigerator is a device for storing food at a low temperature using cold air generated by a refrigerating cycle of compression, condensation, expansion, and evaporation which is continuously performed.

The refrigerating cycle includes a compressor compressing refrigerant, a condenser condensing the compressed refrigerant in a high-temperature and high-pressure state from the compressor through heat dissipation, and an evaporator cooling ambient air through a cooling operation that ambient latent heat is absorbed as the refrigerant provided from the condenser is evaporated. A capillary or an expansion valve is provided between the condenser and the evaporator to increase a flow rate of the refrigerant and lower pressure so that the refrigerant introduced to the evaporator may be easily evaporated.

Cold air generated in the evaporator by the refrigerating cycle is supplied to a food storage space including a freezing chamber and a refrigerating chamber to keep food in the storage space at a low temperature.

Here, the freezing chamber or the refrigerating chamber space is required not only to maintain temperature uniformly spatially but also to keep a predetermined temperature steadily over time. In particular, when a user sets a desired temperature, it is important to control generation of cold air and supply of cold air so that the set temperature may be maintained within an allowable variation range based on the set temperature continuously.

Regarding a control technique of uniformly maintaining temperature of the refrigerating chamber or the freezing chamber constant over time, an operation method of alternately cooling the refrigerating chamber and the freezing chamber as in Patent document 1 is known. According to the alternate operation method, the temperature of the refrigerating chamber is lowered when a cooling operation is performed in the refrigerating chamber cooling operation and increased when a cooling operation is performed in the freezing chamber. That is, the temperature of the refrigerating chamber is controlled to be changed in a substantially zigzag manner over time.

FIG. 1 is a graph illustrating influences of a food storage term according to a temperature change value over time in a refrigerator. As illustrated in FIG. 1, in case where a reference center temperature is 2.5° C. (refrigerating chamber), as a temperature change over time is reduced from ±2.0° C. to ±0.5° C., time during which the weight of stored food is reduced to 95% is increased from 7 days to 10 days.

As a result, as temperature fluctuation of the freezing chamber or the refrigerating chamber over time is reduced, food may be stored fresh, which may improve customer satisfaction.

However, when the temperature change width over time is controlled to be small based on the temperature set by the user in consideration of the above factors, the interval of the alternating operation of the refrigerating chamber and the freezing chamber is shortened. That is, a control device frequently intervenes as many and the number of sensing a temperature in the refrigerating chamber (or freezing chamber) and adjusting cold air supply is increased, increasing power consumption of the refrigerator.

Therefore, in a constant temperature technique for maintaining temperature of the refrigerating chamber or the freezing chamber within a smaller variation from the temperature set by the user, a refrigerator in which power consumption is minimized, while a temperature fluctuation over time is reduced, and a control method thereof are required to be developed.

RELATED ART DOCUMENT (Patent document 1) Korean Patent Laid-Open Publication No. 10-2004-0013157 (Published on Feb. 14, 2004).

DISCLOSURE

Technical Problem

A first aspect of the present disclosure is to provide a refrigerator in which when cooling of a refrigerating chamber is stopped, cold air of a freezing chamber is controlled to be supplied to the refrigerating chamber, while a temperature of the refrigerating chamber is being increased, to delay an increase in temperature of the refrigerating chamber.

A second aspect of the present disclosure is to provide a refrigerator in which after cooling of a freezing chamber is completed, a compressor is controlled to be additionally driven, while cold air of the freezing chamber is being supplied to the refrigerating chamber, thus delaying an increase in temperature of the refrigerating chamber.

A third aspect of the present disclosure is to provide a refrigerator in which a compressor is controlled to be driven by a low load and a fan is controlled to be actuated at a low speed while cooling is performed on a refrigerating chamber, thus reducing a temperature change in the refrigerating chamber and reducing power consumption.

A fourth aspect of the present disclosure is to provide a refrigerator in which a space to be cooled is controlled to be gradually increased at an initial stage of cooling a freezing chamber and a refrigerating chamber, thus reducing power consumption.

Technical Solution

According to a first aspect of the present disclosure, there is provided a refrigerator including: a main body forming a refrigerating chamber and a freezing chamber each including a temperature sensor; a cooling unit having a compressor and an evaporator accommodated inside the main body and driven to circulate a refrigerant in the compressor and the evaporator to generate cold air around the evaporator; a fan positioned inside the main body to supply the cold air to the freezing chamber; a damper positioned between the freezing chamber and the refrigerating chamber and opened and closed to allow the freezing chamber and the refrigerating chamber to selectively communicate with each other; and a controller controlling the damper for a predetermined damper opening time when a temperature of the freezing chamber reaches a freezing satisfaction temperature according to driving of the cooling unit.

According to a second aspect of the present disclosure, there is provided a refrigerator including: a main body forming a refrigerating chamber and a freezing chamber; a cooling unit having a compressor and an evaporator accommodated inside the main body and driven to circulate a refrigerant in the compressor and the evaporator to generate cold air around the evaporator; a fan positioned inside the main body to supply the cold air to the freezing chamber; a damper positioned between the freezing chamber and the refrigerating chamber and opened and closed to allow the freezing chamber and the refrigerating chamber to selectively communicate with each other; and a controller controlling the damper for a predetermined damper opening time when a temperature of the freezing chamber reaches a freezing satisfaction temperature according to driving of the cooling unit, wherein when the temperature of the freezing chamber reaches the freezing satisfaction temperature according to driving of the cooling unit, the controller may further drive the cooling unit for a predetermined additional driving time.

Here, the controller may actuate the fan for the damper opening time and the additional driving time may be set to be shorter than the damper opening time.

According to a third aspect of the present disclosure, there is provided a refrigerator including: a main body forming a refrigerating chamber and a freezing chamber; a cooling unit having a compressor and an evaporator accommodated inside the main body and driven to circulate a refrigerant in the compressor and the evaporator to generate cold air around the evaporator; a fan positioned inside the main body to supply the cold air to the freezing chamber; a damper positioned between the freezing chamber and the refrigerating chamber and opened and closed to allow the freezing chamber and the refrigerating chamber to selectively communicate with each other; and a controller controlling the damper for a predetermined damper opening time when a temperature of the freezing chamber reaches a freezing satisfaction temperature according to driving of the cooling unit, wherein when the temperature of the freezing chamber reaches the freezing satisfaction temperature according to driving of the cooling unit, the controller may further drive the cooling unit for a predetermined additional driving time by a load smaller than that before the temperature of the freezing chamber reaches the freezing satisfaction temperature.

Also, the controller may actuate the fan for the damper opening time at a rotation speed lower than that before the temperature of the freezing chamber reaches the freezing satisfaction temperature.

In addition, when a temperature of the refrigerating chamber is higher than a refrigerating satisfaction temperature during the driving of the cooling unit, the controller may drive the cooling unit by a load value lower than that when the temperature of the refrigerating chamber is lower than the refrigerating satisfaction temperature.

In addition, when a temperature of the refrigerating chamber is higher than a refrigerating satisfaction temperature in a state in which the cooling unit is driven, the controller may actuate the fan at a rotation speed lower than that when the temperature of the refrigerating chamber is lower than the refrigerating satisfaction temperature.

According to a fourth aspect of the present disclosure, there is provided a refrigerator including: a main body forming a refrigerating chamber and a freezing chamber; a cooling unit having a compressor and an evaporator accommodated inside the main body and driven to circulate a refrigerant in the compressor and the evaporator to generate cold air around the evaporator; a fan positioned inside the main body to supply the cold air to the freezing chamber; a damper positioned between the freezing chamber and the refrigerating chamber and opened and closed to allow the freezing chamber and the refrigerating chamber to selectively communicate with each other; and a controller controlling the damper for a predetermined damper opening time when a temperature of the freezing chamber reaches a freezing satisfaction temperature according to driving of the cooling unit, wherein when the temperature of the freezing chamber is higher than a freezing dissatisfaction temperature, the controller drives the cooling unit, and when a predetermined fan delay time has lapsed, the controller actuates the fan and opens the damper.

Or, when the temperature of the freezing chamber is higher than a refrigerating dissatisfaction temperature, the controller may drive the cooling unit, and when a predetermined fan delay time has lapsed, the controller may actuate the fan and open the damper.

Also, when a predetermined damper delay time has lapsed after the actuation of the fan, the controller may open the damper.

According to an aspect of the present disclosure, there is provided a method for controlling a temperature of a refrigerator which includes a cooling unit generating and supplying cold air and cools a refrigerating chamber and a freezing chamber configured to communicate with each other, including: cooling the freezing chamber by the cooling unit in a state in which the refrigerating chamber and the freezing chamber are isolated; and when a temperature of the freezing chamber reaches a freezing satisfaction temperature, allowing the freezing chamber and the refrigerating chamber to communicate with each other for a predetermined communication time.

In the communicating, the cooling unit may be driven for a predetermined additional driving time.

The cooling unit may be driven by a load smaller than that in the cooling of the freezing chamber for the predetermined additional driving time.

The method may further include: cooling the refrigerating chamber before the cooling of the freezing chamber, wherein the cooling unit may be driven in the cooling of the refrigerating chamber by a load smaller than that in the cooling of the freezing chamber.

The method may further include: cooling the refrigerating chamber before the cooling of the freezing chamber, wherein in the cooling of the refrigerating chamber, when a predetermined time has lapsed since the cooling unit started to be driven, the refrigerating chamber and the freezing chamber may communicate with each other.

Advantageous Effects

According to the present disclosure constituted by the above-described solution, the following effects may be obtained.

First, the controller of the refrigerator according to the present disclosure opens the damper when a temperature of the freezing chamber reaches a freezing satisfaction temperature. As a result, a section where a decrease or at least an increase in temperature is delayed is added in the middle of a section in which a temperature of the refrigerating chamber is increased. Therefore, a temperature change width of a section in which the temperature of the refrigerating chamber is increased may be reduced and, in addition, a time interval during which the cooling unit is driven may be secured longer than that in the related art, improving power consumption.

Second, the controller of the refrigerator according to the present disclosure may additionally drive the cooling unit when the freezing satisfaction temperature is reached, thus limiting an increase in temperature of the freezing chamber in supplying cold air to lower the temperature of the refrigerating chamber. Accordingly, power consumption may be reduced, compared with a case where the freezing chamber is cooled after the cooling unit has a relatively high temperature.

Further, the controller sets a damper opening time to be longer than an additional driving time of the cooling unit, whereby cold air remaining around the evaporator may be utilized to the maximum and utilization of power consumption may be maximized.

Third, since the controller of the refrigerator according to the present disclosure drives the cooling unit by a low load while the damper is open after the freezing satisfaction temperature is reached, a slope of a temperature change may be gentler. Accordingly, a temperature change width over time may be reduced and a long cooling unit driving interval may be secured. In addition, power consumption when the cooling unit is driven may also be reduced.

Similarly, the fan is also operated at a low speed while the damper is open after the freezing satisfaction temperature is reached, whereby power consumption may be reduced and the slope of a temperature change over time may be gentle.

Further, even in a refrigerating chamber cooling section in which a temperature of the refrigerating chamber is higher than the refrigerating satisfaction temperature, the cooling unit may be driven by a low load and the fan may be operated at a low speed. Thus, in the section in which the refrigerating chamber is cooled, the slope of the temperature change may be formed to be gentle overall, reducing a temperature change and power consumption.

Fourth, the controller of the refrigerator according to the present disclosure actuates the fan and opens the damper when a fan delay time has lapsed at an initial stage of driving of the cooling unit due to dissatisfaction of freezing or refrigerating, whereby time for sufficiently cooling a space in which the evaporator is accommodated may be secured. This may prevent an initial increase in temperature of the freezing chamber to contribute to improvement of power consumption.

Further, since the damper is opened when a damper delay time of has lapsed since the fan was actuated, the freezing chamber may communicate with the refrigerating chamber after it sufficiently receives cold air so as to be cooled. Similarly, an initial increase in the temperature of the freezing chamber may be prevented and cooling efficiency and power consumption may be improved by gradually increasing a cooling space.

BEST MODES

Hereinafter, a refrigerator and a control method thereof according to an embodiment of the present disclosure will be described in detail with reference to the accompanying drawings.

Like numbers refer to like elements throughout although the embodiments are different, and a description of the like elements a first embodiment will be used for those of the different embodiment.

In describing the present invention, if a detailed explanation for a related known function or construction is considered to unnecessarily divert the gist of the present invention, such explanation has been omitted but would be understood by those skilled in the art.

The accompanying drawings of the present invention aim to facilitate understanding of the present invention and should not be construed as limited to the accompanying drawings. Also, the present invention is not limited to a specific disclosed form, but includes all modifications, equivalents, and substitutions without departing from the scope and spirit of the present invention.

Figure 1:
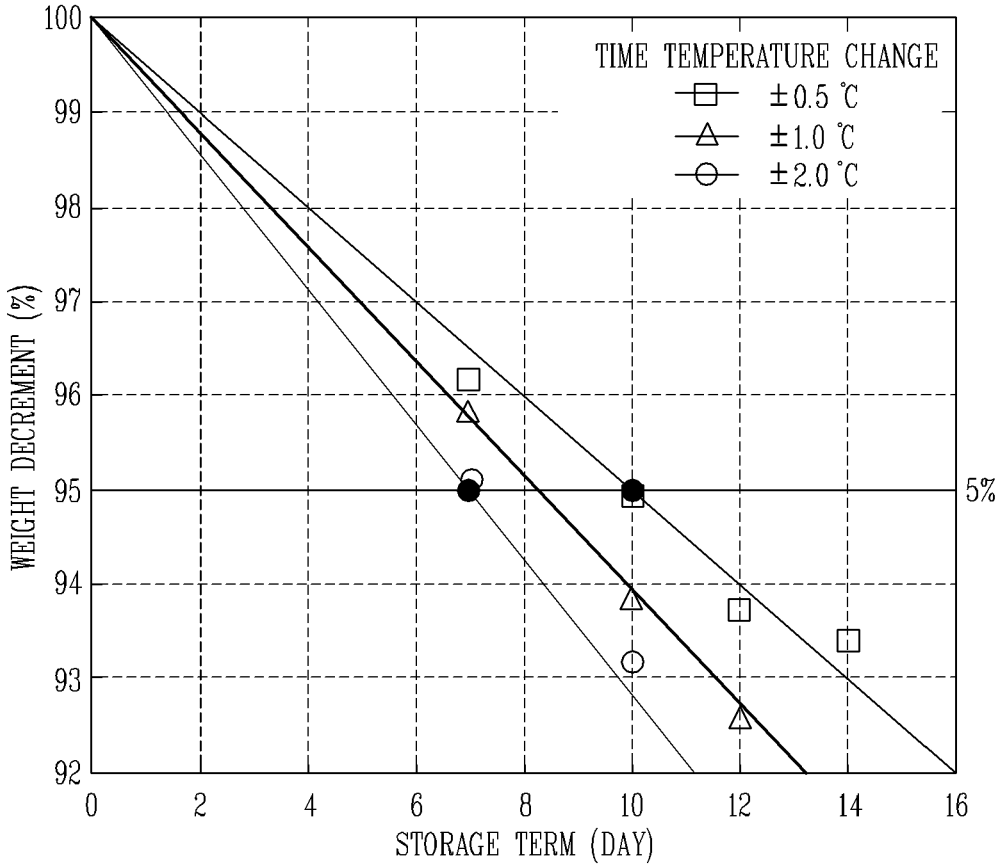
FIG. 1 is a graph illustrating influences of a food storage term according to a temperature change value over time in a refrigerator.
Figure 2:
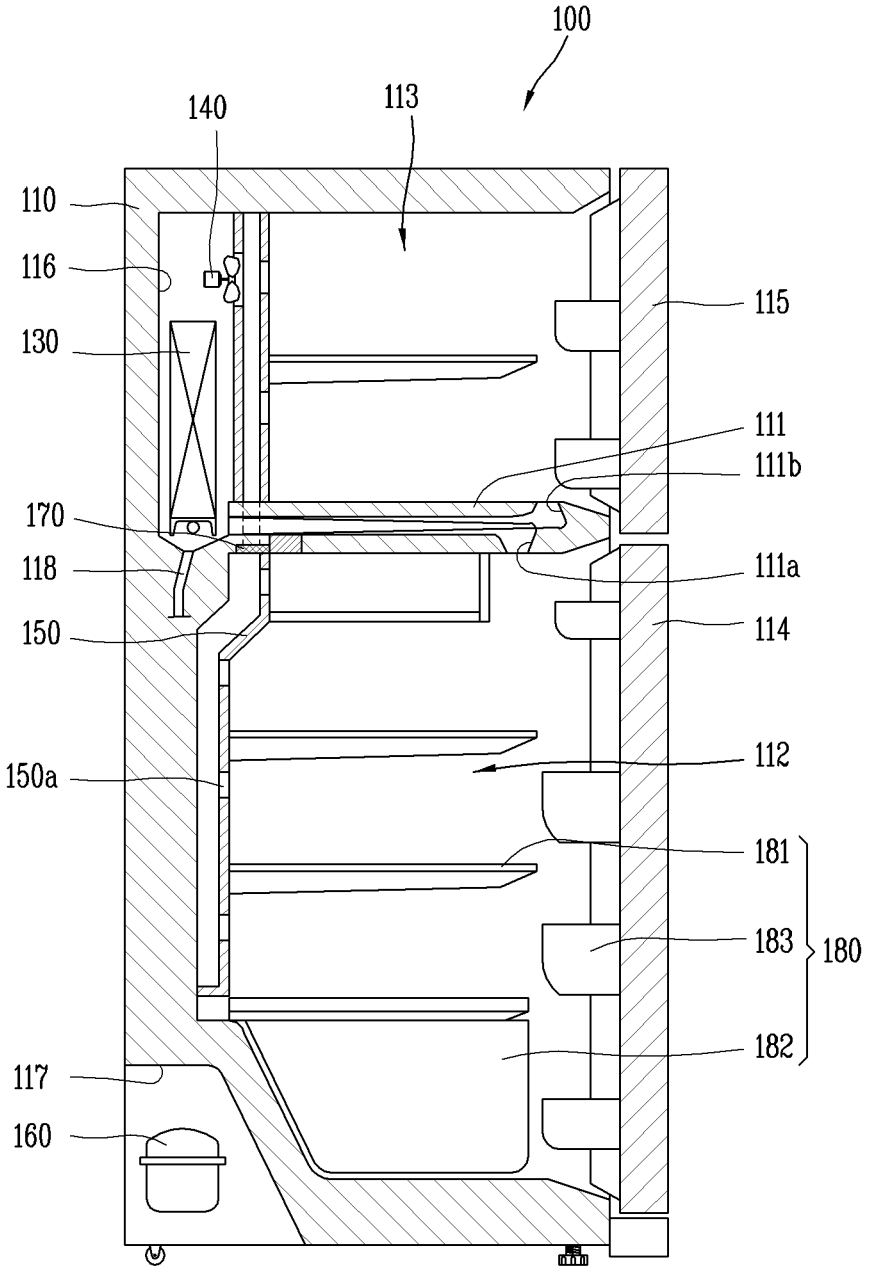
FIG. 2 is a longitudinal sectional view schematically illustrating a configuration of a refrigerator according to the present disclosure.

FIG. 2 is a longitudinal sectional view schematically illustrating a configuration of a refrigerator 100 according to the present disclosure. The refrigerator 100 according to the present disclosure is a device for keeping food stored in the refrigerator at low temperature using cold air generated by a refrigerating cycle in which a process of compression, condensation, expansion, and evaporation is continuously performed.

As illustrated in FIG. 2, a main body 110 includes a refrigerating chamber 112 and a freezing chamber 113 for storing food therein. The refrigerating chamber 112 and the freezing chamber 113 may be separated by a partition 111 and may have different set temperatures.

In this embodiment, a top mount type refrigerator in which the freezing chamber 113 is disposed above the refrigerating chamber 112 is illustrated, but the present disclosure is not limited thereto. The present disclosure is also applicable to a side-by-side type refrigerator in which a refrigerating chamber and a freezing chamber are disposed from side to side, a bottom freezer type refrigerator in which a refrigerating chamber is provided on an upper side and a freezing chamber is provided on a lower side, and the like.

A door is connected to the main body 110 to open and close a front opening of the main body 110. In this figure, it is illustrated that a refrigerating chamber door 114 and a freezing chamber door 115 are configured to open and close the refrigerating chamber 112 and the freezing chamber 113, respectively. The doors may be variously configured as a rotary door rotatably connected to the main body 110, a drawer-type door slidably connected to the main body 110, and the like.

The main body 110 includes at least one receiving unit (or storage unit) 180 (e.g., a shelf 181, a tray 182, a basket 183, etc.) for efficient utilization of the internal storage space. For example, the shelf 181 and the tray 182 may be installed inside the main body 110, and the basket 183 may be installed inside the door connected to the main body 110 of the refrigerator 100.

A cooling chamber 116 provided with an evaporator 130 and a fan 140 is provided on the rear side of the freezing chamber 113. The partition wall 111 includes a refrigerating chamber return duct 111*a* and a freezing chamber return duct 111*b* through which air of the refrigerating chamber 112 and the freezing chamber 113 may be intaken and returned to the cooling chamber 116 side.

A cold air duct 150 communicating with the freezing chamber 113 and having a plurality of cold air discharge openings 150*a* may be installed on the rear side of the refrigerating chamber 112.

A mechanic chamber 117 is provided in a lower portion of the rear surface of the main body 110, and a compressor 160 and a condenser (not shown) are provided inside the mechanic chamber 117. In the refrigerator 100 according to the present disclosure, a driving unit may include an evaporator 130 and a compressor 160 and may further include a condenser (not shown), or the like.

When the driving unit including the compressor 160 is driven, a refrigerant flowing in the evaporator 130 absorbs ambient latent heat and is evaporated, generating cold air around the evaporator 130. The cooling chamber 116 is cooled by the generated cold air, and when the fan 140 is actuated, the generated cold air may be supplied to the freezing chamber 113.

A damper 170 is mounted between the refrigerating chamber 112 and the freezing chamber 113. The damper 170 is operated so that the freezing chamber 113 and the refrigerating chamber 112 may communicate with each other. That is, when the damper 170 is opened by the controller, cold air from the freezing chamber 113 may be supplied to the refrigerating chamber 112, and when the damper 170 is closed, the cold air may not be supplied to the refrigerating chamber.

As illustrated in FIG. 2, the refrigerator 100 of the present disclosure includes a refrigerating cycle (one compressor and one evaporator) for cooling the refrigerating chamber 112 and the freezing chamber 113 through one compressor 160 and one evaporator 130.

In the refrigerator 100 of the present disclosure, a temperature sensor (not shown) is provided in each of the refrigerating chamber 112 and the freezing chamber 113. A plurality of temperature sensors may be installed in each of the refrigerating chamber 112 and the freezing chamber 113. The respective temperatures sensed by the temperature sensors of the refrigerating chamber 112 and the freezing chamber 113 are used to control the controller (not shown) provided in the refrigerator 100 of the present disclosure.

In particular, the controller of the refrigerator 100 according to the present disclosure controls the cooling unit, the fan 140, and the damper 140 such that the temperatures of the refrigerating chamber 112 and the freezing chamber 113 are kept steady with time.

Specifically, in the refrigerating chamber 112, for example, the cooling unit is operated to maintain a predetermined variation (e.g., ±0.5° C.) with respect to a refrigerating chamber center temperature (e.g., 3° C.) set by the user. Hereinafter, a value obtained by adding a predetermined variation to the refrigerating chamber center temperature is defined as a refrigerating dissatisfaction temperature (e.g., 3.5° C.), and a value obtained by subtracting the predetermined variation from the refrigerating chamber center temperature is defined as a refrigerating satisfaction temperature (e.g., 2.5° C.).

Similarly, in the case of the freezing chamber 113, a temperature of the freezing chamber 113 may be controlled to be maintained between a freezing dissatisfaction temperature to which a predetermined variation was added and a freezing satisfaction temperature from which the predetermined variation was subtracted with respect to a freezing chamber center temperature (−18° C.) set by the user.

Figure 3:
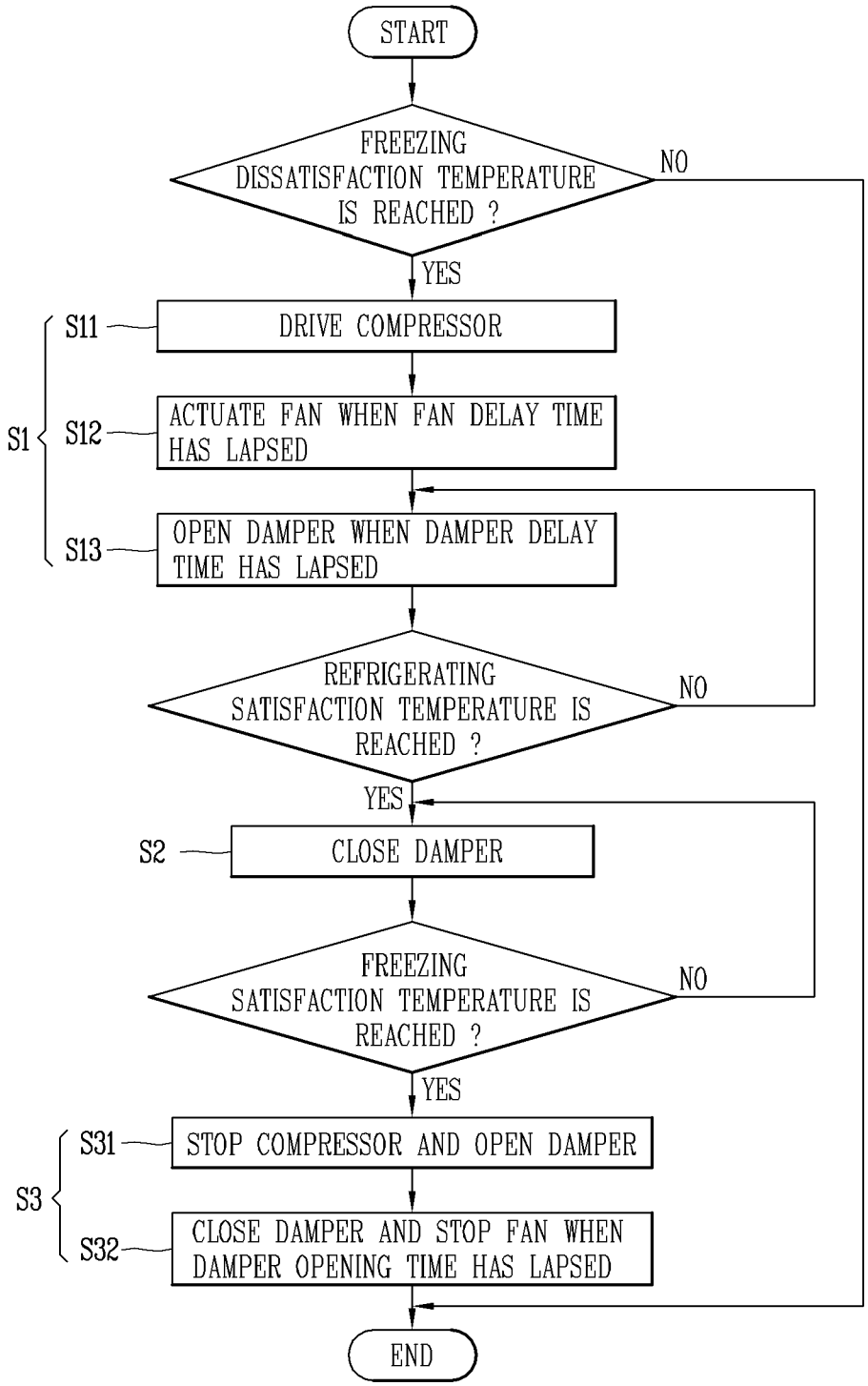
FIG. 3 is a flowchart illustrating a method of controlling a temperature of a refrigerating chamber illustrated in FIG. 2 according to an embodiment of the present disclosure.

FIG. 3 is a flowchart illustrating a method of controlling a temperature of the refrigerating chamber 112 illustrated in FIG. 2 according to an embodiment of the present disclosure. In FIG. 3, driving and stopping of the compressor 160 refers to driving and stopping the driving unit including the compressor 160.

According to FIG. 3, in this embodiment, the cooling unit starts to be driven when the freezing dissatisfaction temperature is detected. That is, when a temperature of the freezing chamber 113 is increased beyond the predetermined variation allowed from the freezing chamber center temperature, the cooling unit may start to be driven by the controller (S11).

After the cooling unit starts to be driven, when a predetermined fan delay time has passed, the controller actuates the fan 140, and thereafter, when a predetermined damper delay time has passed, the controller opens the damper 170 (S13). A specific configuration and effect according to the fan delay time and the damper delay time will be described later.

FIG. 3 shows an embodiment of a cooling scheme in which simultaneous cooling of the refrigerating chamber 112 and the freezing chamber 113 and single cooling of the freezing chamber 113 are alternately performed. That is, steps from step S11 in which the cooling unit is driven to step S13 in which the damper 170 is opened are included in step S1 in which the refrigerating chamber 112 and the freezing chamber 113 are simultaneously cooled.

While the refrigerating chamber 112 and the freezing chamber 113 are simultaneously cooled, when a temperature of the refrigerating chamber 112 reaches the refrigeration satisfaction temperature, the damper 170 is closed and the single cooling step S2 is performed in the refrigerating chamber 112. In a state in which the damper 170 is closed, cold air is not supplied to the refrigerating chamber 112, and thus, a temperature of the refrigerating chamber 112 is increased and a temperature of the freezing chamber 113 is lowered due to cold air supply.

Here, unlike the related art driving scheme, the refrigerator 100 according to the present disclosure includes step S3 of opening the damper 170 to supply cold air to the refrigerating chamber 112 when the freezing satisfaction temperature is reached, to supply cold air to the refrigerating chamber 112. That is, the controller may be configured to open the damper 170 (S31) when the freezing satisfaction temperature is reached, and to close the damper 170 (S32) when a predetermined damper opening time has lapsed.

Here, in this embodiment, the cooling unit may be stopped in the step S3 of opening the damper 170. However, the fan 140 may be operated for the damper opening time to supply cold air remaining in the cooling chamber 116 to the freezing chamber 113 and the refrigerating chamber 112.

The damper opening time may be set in consideration of capacity of the driving unit of the refrigerator 100 of the present disclosure to which the controller of the present disclosure is applied, a volume of the refrigerating chamber 112 and the freezing chamber 113, and the like. In particular, the damper opening time may be set to a time during which a temperature of cold air discharged from the cooling chamber 113 accommodating the evaporator 130 and a temperature of the freezing chamber 113 are similar. Furthermore, a temperature sensor may be further provided in the cooling chamber 116 to compare temperature values of the freezing chamber 113 and the cooling chamber 116 to control opening of the damper 170 in real time.

Figure 4:
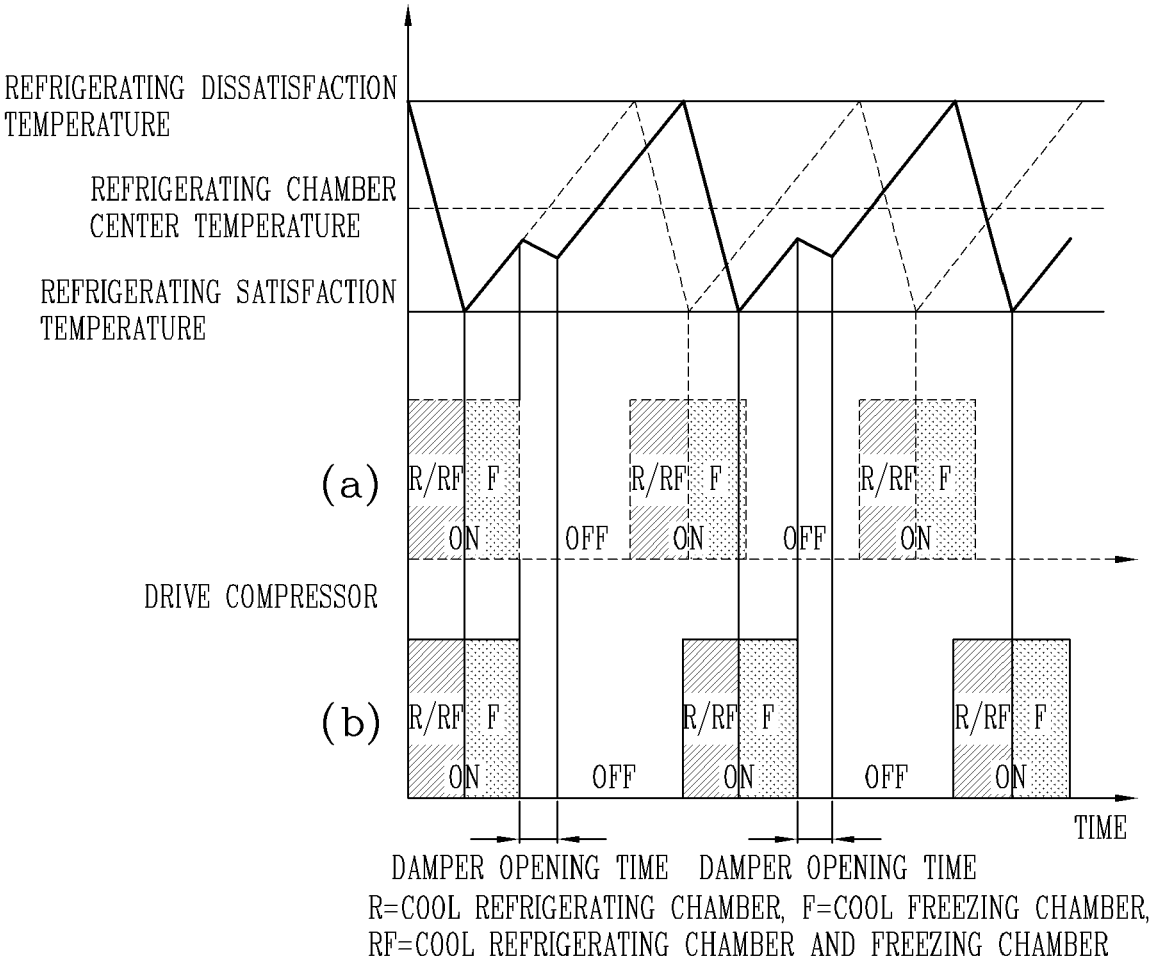
FIG. 4 is a graph illustrating a temperature change of a refrigerating chamber controlled in temperature according to the flowchart illustrated in FIG. 3, compared with a related art.

FIG. 4 is a graph illustrating a temperature change of a refrigerating chamber controlled in temperature according to the flowchart illustrated in FIG. 3, compared with the related art. The dotted line and (a) indicate a case where the refrigerator is controlled by the conventional method, and the solid line and (b) show the case where the refrigerator of the present disclosure is controlled by the controller of the present disclosure.

In the case of FIG. 4 (*a*), except for a cooling section R or RF of the refrigerating chamber, the temperature of the refrigerating chamber increases regardless of whether the freezing chamber is cooled or not. When the temperature of the refrigerating chamber increases to reach the refrigerating dissatisfaction temperature, cooling of the refrigerating chamber may be started again by the cooling unit.

In contrast, in the case of the present disclosure illustrated in (b) of FIG. 4, a temperature increase of the refrigerating chamber 112 for the damper opening time may be delayed at the time when cooling of the freezing chamber 113 is completed (when the freezing satisfaction temperature is reached). The delay of the temperature increase may appear as a temperature drop as illustrated in FIG. 4, but it may also appear a level at which the related art rising slope is small in some cases.

Due to the provision of the damper opening time, a temperature increase width may be resultantly reduced on the basis of the same time points as those of the related art. Accordingly, within the predetermined temperature change range, the temperature of the refrigerating chamber 112 may be kept closer to the refrigerating chamber center temperature, and thus, the temperature of the refrigerating chamber 112 may be maintained at a steady level with time.

Further, (a) and (b) of FIG. 4 are compared, there is an effect that a time duration in which the cooling unit is driven is longer than that of the related art. This means that, in the refrigerator 100 of the present disclosure, an operation interval of the controller for temperature control is further increased, and thus, power consumption may be reduced.

Particularly, in the related art method, when the predetermined variation is reduced on the basis of the refrigerating chamber center temperature (e.g., from ±2° C. to ±0.5° C.), a control time interval of the controller may be further lengthened. Here, if step S3 of delaying a temperature increase by opening the damper 170 is additionally performed as in the present disclosure, the control time interval of the controller may be lengthened, and thus, more accurate temperature change control may be achieved with low power consumption.

Figure 5:
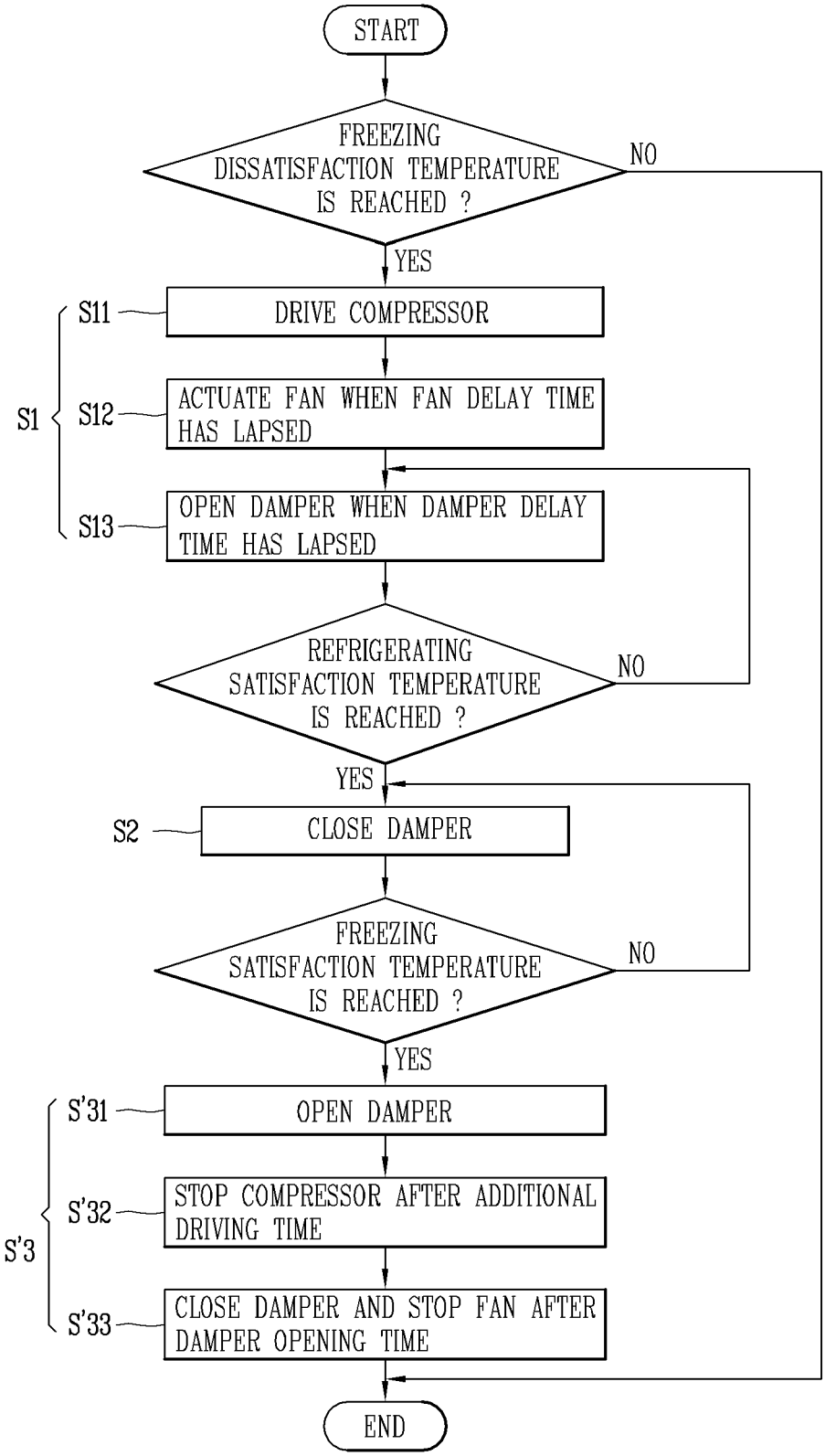
FIG. 5 is a flowchart illustrating a method of controlling a temperature of the refrigerating chamber illustrated in FIG. 2 according to another embodiment of the present disclosure.

FIG. 5 is a flowchart illustrating a method of controlling a temperature of the refrigerating chamber 112 illustrated in FIG. 2 according to another embodiment of the present disclosure. In the embodiment of FIG. 5, additional cooling power is supplied by adding additional driving of the cooling unit to the previous embodiment.

As in the previous embodiment, when the temperature of the freezing chamber 113 increases to reach the freezing dissatisfaction temperature, the controller of the refrigerator 100 according to the present disclosure may drive the driving unit (S11).

Also, the controller may operate the fan 140 (S12) and open the damper 170 (S13) with a delay time of the fan 140 and a delay time of the damper 170, respectively. Accordingly, the refrigerator 100 of the present disclosure performs step S1 of cooling the refrigerating chamber 112 and the freezing chamber 113.

Next, when the temperature of the refrigerating chamber 112 reaches the refrigerating satisfaction temperature, the controller closes the damper 170. As a result, the refrigerator 100 of the present disclosure is switched to step S2 of cooling the freezing chamber 113.

Next, when the temperature of the freezing chamber 113 reaches the freezing satisfaction temperature, the controller of the refrigerator 100 according to the present disclosure first opens the damper 170 (S'31). Also, after maintaining driving of the cooling unit (compressor 10) for a predetermined additional driving time, the controller stops the operation of the cooling unit (compressor 160) (S'32).

In this embodiment, when step S'3 in which the damper 170 is opened during a rest period in which the refrigerating chamber 112 is not cooled is performed, the cooling unit may be additionally driven. Since the cooling unit additionally provides cold air to the freezing chamber 113 and the refrigerating chamber 112, cold air may be additionally supplied to the freezing chamber 113, while a temperature increase of the refrigerating chamber 113 is delayed. As a result, an effect of limiting a temperature increase of the freezing chamber 113 is obtained in addition to the effect of the previous embodiment.

When the temperature increase of the freezing chamber 113 is limited, an interval up to next driving of the cooling unit may be lengthened or a next driving time of the cooling unit may be reduced, reducing power consumption.

Furthermore, during the additional driving time, the cooling unit may be operated in a sufficiently established low temperature environment, and thus, cooling may be performed more efficiently than in a next cooling operation of the cooling unit having a relatively high temperature.

Meanwhile, in the present embodiment, the fan 140 is actuated together for the damper opening time, and the additional driving time of the cooling unit may be set shorter than the damper opening time. For example, the damper opening time may be set to 150 seconds, and the additional driving time of the driving unit may be set to be shorter. That is, after the cooling unit is additionally driven and stopped (S'32), when the damper opening time has lapsed, the damper may be closed and the fan may be stopped in step S'33.

In the cooling chamber 116 in which the evaporator 130 of the refrigerator 100 according to the present disclosure is present, a certain amount of already generated cold air is present even though driving of the cooling unit is stopped. Thus, even after the compressor 160 is stopped, the fan 140 is operated for a certain period of time and the damper 170 is left open to delay a temperature increase of the refrigerating chamber 112 by utilizing cold air remaining around the evaporator 130 to the maximum. This configuration may contribute to a reduction of power consumption.

In the above, the configuration for reducing a temperature increase width of the refrigerating chamber 112 by adding the section in which the damper 170 is opened between rest periods in which the refrigerating chamber 112 is not cooled and the temperature increases according to the one embodiment and another embodiment of the present disclosure has been described. Hereinafter, another embodiment of the present disclosure in which the temperature change width is reduced in each section in which the refrigerating chamber 112 is cooled will be described.

Figure 6:
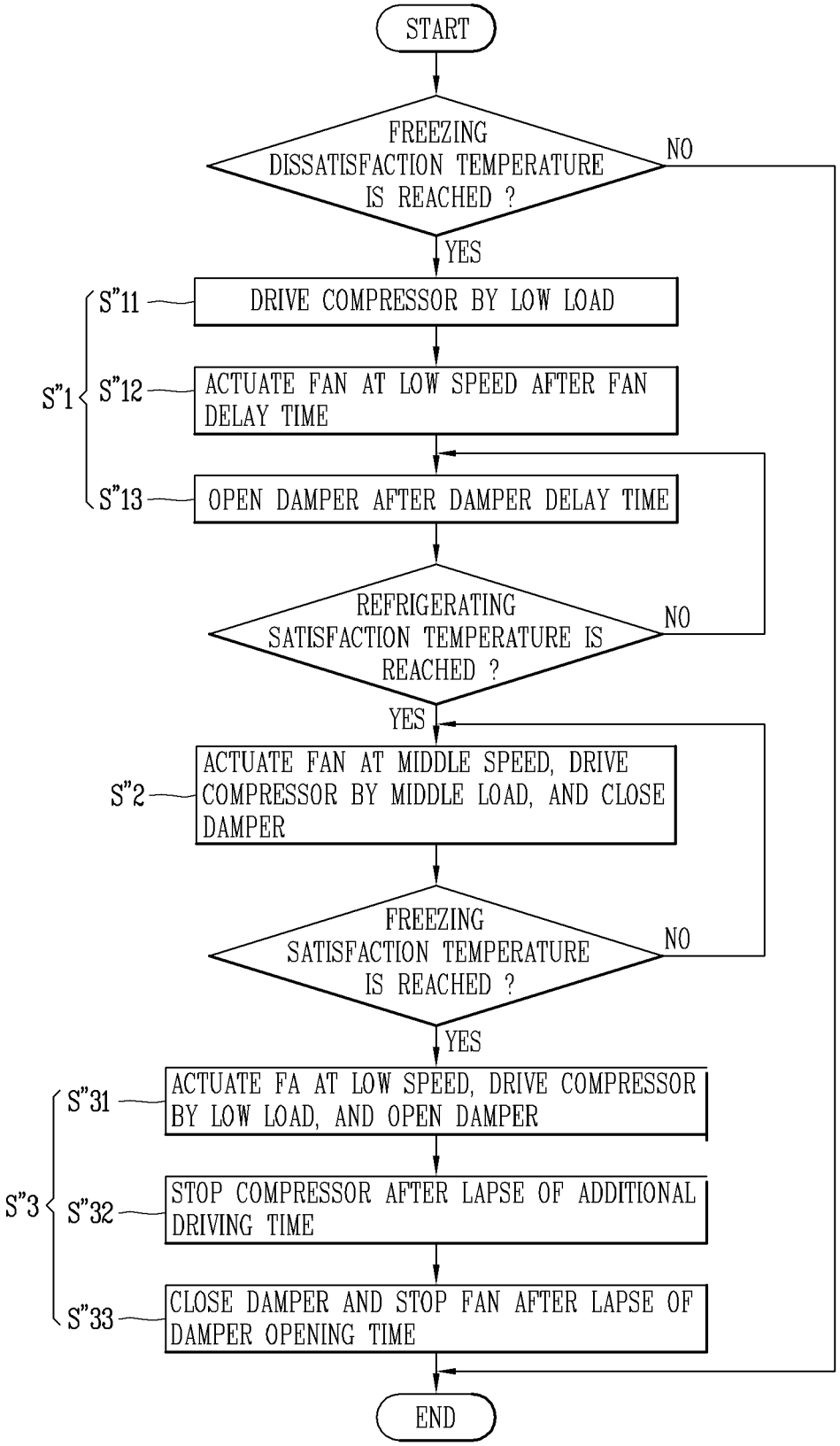
FIG. 6 is a flowchart illustrating a method of controlling a temperature of the refrigerating chamber illustrated in FIG. 2 according to another embodiment of the present disclosure.
Figure 7:
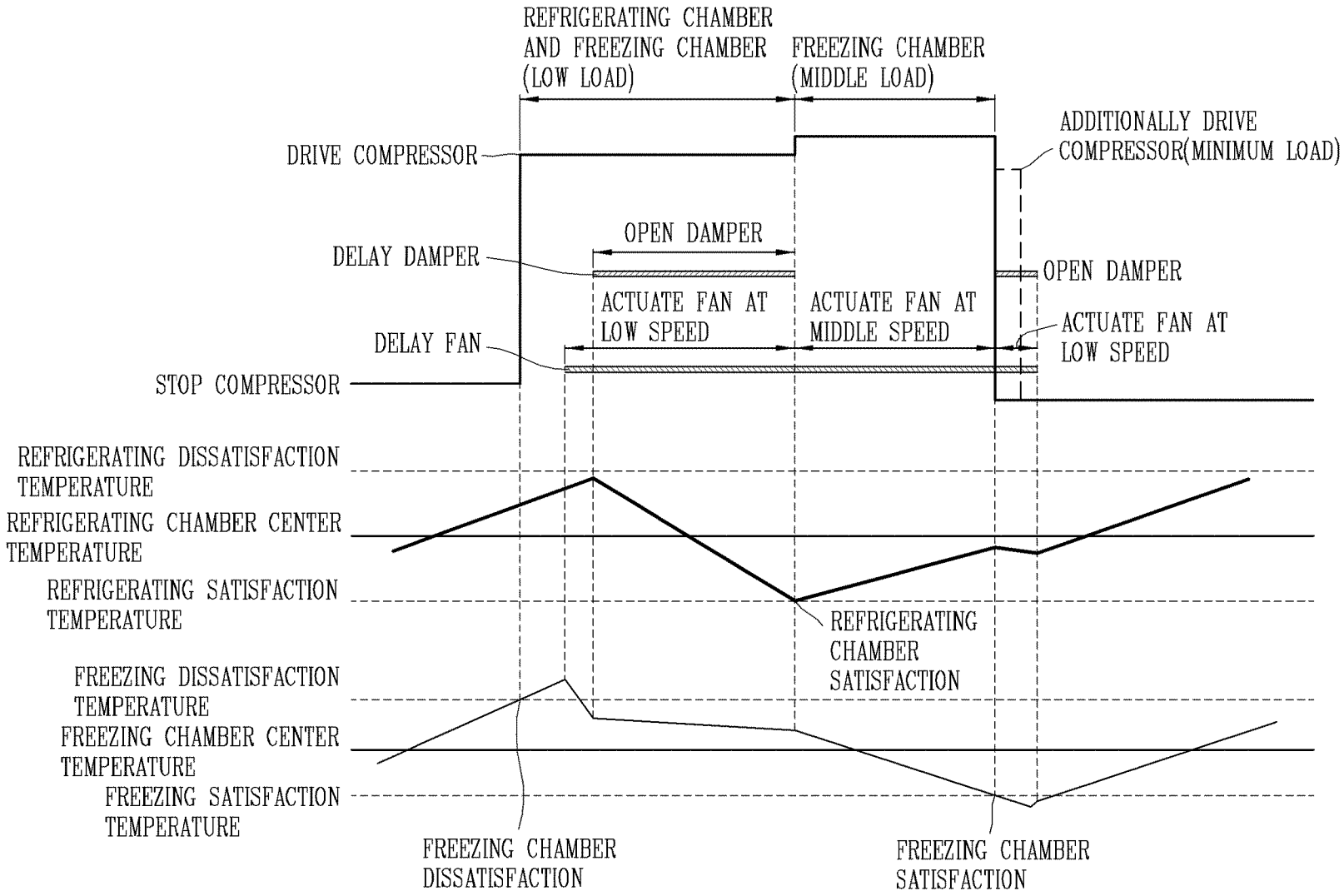
FIG. 7 is a conceptual view illustrating a state of a compressor, a fan, and a damper illustrated in FIG. 2 operated according to the flowchart illustrated in FIG. 6, and a change in temperature of the freezing chamber and the refrigerating chamber according to the states thereof.

FIG. 6 is a flowchart illustrating a method of controlling a temperature of the refrigerating chamber 112 illustrated in FIG. 2 according to another embodiment of the present disclosure. FIG. 7 is a conceptual view illustrating a state of the compressor 160, the fan 140, and the damper 170 illustrated in FIG. 2 operated according to the flowchart illustrated in FIG. 6, and a change in temperature of the freezing chamber 113 and the refrigerating chamber 112 according to the states thereof. This embodiment corresponds to a case where the controller varies a load of the cooling unit (compressor 160) and a speed of the fan 140 on the basis of the previous other embodiment.

As in the previous embodiment and other embodiments, when the temperature of the freezing chamber 113 increases to reach the freezing dissatisfaction temperature, the controller of the present disclosure may drive the driving unit (S"11). Accordingly, the refrigerator 100 of the present disclosure starts to perform step S"1 of cooling the refrigerating chamber 112 and the freezing chamber 113.

Thereafter, when the temperature of the refrigerating chamber 112 reaches the refrigerating satisfaction temperature, the controller closes the damper 170. Accordingly, the refrigerator 100 of the present disclosure is switched to step (S"2) of cooling the freezing chamber 113.

Next, when the temperature of the freezing chamber 113 reaches the freezing satisfaction temperature, the controller of the refrigerator 100 according to the present disclosure opens the damper 170 (S"31). The controller maintains driving of the cooling unit (compressor 160) during the predetermined additional driving time, and thereafter, the controller stops the driving of the cooling unit (S"32). After the lapse of the damper opening time, the controller may close the damper and stop the fan (S"33).

In the above steps, in the damper opening step S"31, a load of the cooling unit may be varied to be smaller than that before the freezing satisfaction temperature is reached (S"2). That is, when the driving unit is additionally driven, the driving unit may be operated by a relatively low load to generate a relatively smaller amount of cold air. In particular, as illustrated in FIG. 7, the driving unit may be operated by a minimum load that may be driven.

According to the present disclosure, in step S"3 of delaying the temperature increase of the refrigerating chamber 112 by opening the damper 170 for the damper opening time, high cooling power for rapidly lowering the temperature is not required although the compressor 160 is operated for the additional driving time. Rapid cooling may rather increase the temperature change width. Thus, cooling power of the compressor 160 is maintained to be smaller than that in the step of cooling the freezing chamber 113, a previous step, for the additional driving time, whereby the temperature may be gradually changed and power consumption may be reduced.

Also, even when the fan 140 is actuated for the damper opening time, the fan 140 may be varied (S"31) at a speed lower than that before the refrigerating satisfaction temperature is reached as illustrated in FIG. 7. When the fan 140 rotates at a low speed, power consumption for actuating the fan 140 may be reduced and a temperature change of the refrigerating chamber 112 may be gentle, obtaining an advantageous effect of maintaining a predetermined temperature of the refrigerating chamber 112.

In the present embodiment, the load of the cooling unit may be reduced or the speed of the fan 140 may be operated at a low speed also in the step S"1 of cooling the refrigerating chamber 112 and the freezing chamber 113 simultaneously.

Specifically, when the temperature of the refrigerating chamber 112 is higher than the refrigerating satisfaction temperature (S"1), the controller may drive the cooling unit in a state I which a load of the cooling unit is reduced, compared with a case (S"2) in which the temperature of the refrigerating chamber 112 is lower than the refrigerating satisfaction temperature.

In addition, when the temperature of the refrigerating chamber 112 is higher than the refrigerating satisfaction temperature (S"1), the controller may actuate the fan 140 in a state in which a rotation speed of the fan 140 is reduced, compared with the case (S"2) where the temperature of the refrigerating chamber 112 is lower than the refrigerating satisfaction temperature.

Through the low load and low speed operation, the temperature drop slope with time in the refrigerating chamber 112 may be gentle in step S"1 of supplying cold air to the refrigerating chamber 112. Therefore, as mentioned above, the reduction of power consumption and the reduction in temperature change width may be achieved together.

Meanwhile, in the above embodiments of the refrigerator 100 according to the present disclosure, when the freezing dissatisfaction temperature is reached, the controller controls the fan 140 and the damper 170 with the fan delay time and the damper delay time, respectively (S12 and S13, S"12 and S"13). Such a configuration has the purpose of sequentially enlarging a cooling space at the beginning of the actuation of the cooling unit.

More specifically, the controller drives the cooling unit when the temperature of the freezing chamber 113 is higher than the freezing dissatisfaction temperature. Here, after the cooling unit is driven, when the predetermined fan delay time has lapsed, the controller operates the fan 140 and the damper 170.

Since a time difference corresponding to the fan delay time is provided between the driving of the cooling unit and the actuation of the fan 140, the cooling chamber 116 in which the evaporator 130 is accommodated may be first sufficiently cooled during the fan delay time. That is, since sufficient cooling is performed from the vicinity of the evaporator 130, power consumption is reduced and the freezing chamber 113 may be effectively cooled.

Further, in the refrigerator 100 according to the present disclosure, the controller may open the damper 170 (S13 and S"13) when the predetermined damper delay time has lapsed since the fan 140 was actuated. That is, first, the driving unit may be first driven to generate cold air around the evaporator 130, cold air may be supplied to the freezing chamber 113 after the fan delay time, and cold air may be supplied to the refrigerating chamber 112 after the damper delay time.

If the actuation of the fan 140 and opening of the damper 170 are performed at the same time, heat exchange is likely to take place between the refrigerating chamber 112 and the freezing chamber 113 in a state in which sufficient cold air is not generated. For example, air in the refrigerating chamber 112 of 3 and air in the freezing chamber 113 of −18 may be heat exchanged, and accordingly, the temperature of the freezing chamber 113 may rise. When the temperature of the freezing chamber 113 increases, a driving time of the cooling unit is increased as much to increase power consumption.

Thus, when cold air generated in the cooling chamber 116 is sequentially supplied to the freezing chamber 113 and the refrigerating chamber 112 as in the present disclosure, the possibility in which the temperature of the freezing chamber 113 increases at the initial driving step of the cooling unit may be eliminated. That is, cooling efficiency may be enhanced and power consumption may be reduced.

The above-described fan delay time and damper delay time may be applied in the same manner to the case where the temperature of the refrigerating chamber 112 reaches the refrigerating dissatisfaction temperature and the cooling unit is operated.

A method of controlling the refrigerator 100 according to another embodiment of the present disclosure will now be described. The refrigerator 100 according to the present disclosure may include a cooling unit for generating and supplying cold air and the refrigerating chamber 112 and the freezing chamber 113 which communicate with each other and are cooled by the cooling unit.

First, when the freezing dissatisfaction temperature or the refrigerating dissatisfaction temperature is detected, the cooling unit may be actuated to cool the refrigerating chamber 112 in step S"1. In the step of cooling the refrigerating chamber 112, the cooling unit may be driven by a low load, compared with a step of cooling the freezing chamber 113 described below. Particularly, after the cooling unit is driven, when a predetermined time has lapsed, the refrigerating chamber 112 and the freezing chamber 113 may communicate with each other in steps S"12 and S" 13.

Next, when the refrigerating satisfaction temperature is detected, the freezing chamber 113 may be cooled by the cooling unit in a state in which the freezing chamber 112 and the freezing chamber 113 are separated from each other (S"2).

When the freezing satisfaction temperature is detected, the refrigerating chamber 112 and the freezing chamber 113 may be allowed to communicate for a predetermined communication time (S"3). Here, the communication time may be the damper opening time. In this step, the cooling unit may be stopped or may be further driven for an additional driving time (S"32). When the cooling unit is driven for the additional driving time, the cooling unit may be driven at a load lower than that in the step of cooling the freezing chamber 113.

The embodiments described above are merely embodiments for implementing the refrigerator and the control method thereof according to the present disclosure, and the present disclosure is not limited thereto and it will be understood by those skilled in the art that various changes in form and details may be made therein without departing from the spirit and scope of the present invention as defined by the appended claims.

INDUSTRIAL APPLICABILITY

The present disclosure may be applied to a refrigerator in which a temperature of an internal space is maintained at a low temperature by a refrigerating cycle including a compressor and an evaporator.

The invention claimed is:

1. A refrigerator comprising:

a main body defining a refrigerating chamber and a freezing chamber that each include a temperature sensor;

a cooling unit including a compressor and an evaporator accommodated inside the main body, the cooling unit being configured to be driven to circulate a refrigerant in the compressor and the evaporator to generate cold air around the evaporator;

a fan positioned inside the main body and configured to supply the cold air to the freezing chamber;

a damper positioned between the freezing chamber and the refrigerating chamber and configured to be opened and closed to allow the freezing chamber and the refrigerating chamber to selectively communicate with each other; and a controller configured to:

control the damper for a predetermined damper opening time when a temperature of the freezing chamber reaches a freezing satisfaction temperature according to driving of the cooling unit, and actuate the fan for the damper opening time at a first rotation speed that is lower than a second rotation speed before the temperature of the freezing chamber reaches the freezing satisfaction temperature.

2. The refrigerator of claim 1, wherein when the temperature of the freezing chamber reaches the freezing satisfaction temperature according to driving of the cooling unit, the controller further drives the cooling unit for a predetermined additional driving time.

3. The refrigerator of claim 2, wherein the controller actuates the fan for the damper opening time and the additional driving time is set to be shorter than the damper opening time.

4. The refrigerator of claim 2, wherein the controller drives the cooling unit for the damper opening time by reducing a load of the cooling unit to be smaller than that before the temperature of the freezing chamber reaches the freezing satisfaction temperature.

5. The refrigerator of claim 1, wherein when a temperature of the refrigerating chamber is higher than a refrigerating satisfaction temperature during the driving of the cooling unit, the controller drives the cooling unit by a load value lower than that when the temperature of the refrigerating chamber is lower than the refrigerating satisfaction temperature.

6. The refrigerator of claim 1, wherein when a temperature of the refrigerating chamber is higher than a refrigerating satisfaction temperature in a state in which the cooling unit is driven, the controller actuates the fan at a rotation speed lower than that when the temperature of the refrigerating chamber is lower than the refrigerating satisfaction temperature.

7. The refrigerator of claim 1, wherein when the temperature of the freezing chamber is higher than a freezing dissatisfaction temperature, the controller drives the cooling unit, and when a predetermined fan delay time has lapsed, the controller actuates the fan and opens the damper.

8. The refrigerator of claim 7, wherein the controller opens the damper when a predetermined damper delay time has lapsed after the actuation of the fan.

9. The refrigerator of claim 1, wherein when the temperature of the freezing chamber is higher than a refrigerating dissatisfaction temperature, the controller drives the cooling unit, and when a predetermined fan delay time has lapsed, the controller actuates the fan and opens the damper.

10. The refrigerator of claim 9, wherein the controller opens the damper when a predetermined damper delay time has lapsed after the actuation of the fan.

11. A method for controlling a refrigerator that includes a main body defining a refrigerating chamber and a freezing chamber that each include a temperature sensor, a cooling unit configured to generate and supply cold air and to cool the refrigerating chamber and the freezing chamber, a fan positioned inside the main body and configured to supply the cold air to the freezing chamber, a damper positioned between the freezing chamber and the refrigerating chamber and configured to be opened and closed to allow the freezing chamber and the refrigerating chamber to selectively communicate with each other, and a controller configured to control the damper and the fan, the method comprising:

cooling the freezing chamber by the cooling unit in a state in which the refrigerating chamber and the freezing chamber are isolated;

controlling the damper for a predetermined damper opening time when a temperature of the freezing chamber reaches a freezing satisfaction temperature; and actuating the fan for the damper opening time at a first rotation speed that is lower than a second rotation speed before the temperature of the freezing chamber reaches the freezing satisfaction temperature.

12. The method of claim 11, further comprising driving the cooling unit for a predetermined additional driving time.

13. The method of claim 12, wherein driving the cooling unit comprises:

driving the cooling unit by a load less than a load for cooling the freezing chamber for the predetermined additional driving time.

14. The method of claim 11, further comprising:

cooling the refrigerating chamber before the cooling of the freezing chamber, wherein the cooling unit is driven in the cooling of the refrigerating chamber by a load smaller than that in the cooling of the freezing chamber.

15. The method of claim 11, further comprising:

cooling the refrigerating chamber before the cooling of the freezing chamber, wherein, in the cooling of the refrigerating chamber, when a predetermined time has lapsed since the cooling unit started to be driven, the refrigerating chamber and the freezing chamber communicate with each other.

16. A refrigerator comprising:

a main body defining a refrigerating chamber and a freezing chamber that each include a temperature sensor;

a cooling unit including a compressor and an evaporator accommodated inside the main body, the cooling unit being configured to be driven to circulate a refrigerant in the compressor and the evaporator to generate cold air around the evaporator;

a fan positioned inside the main body and configured to supply the cold air to the freezing chamber;

a damper positioned between the freezing chamber and the refrigerating chamber and configured to be opened and closed to allow the freezing chamber and the refrigerating chamber to selectively communicate with each other; and a controller configured to:

control the damper for a predetermined damper opening time based on a temperature of the freezing chamber reaching a freezing satisfaction temperature by driving the cooling unit, and based on a temperature of the refrigerating chamber being higher than a refrigerating satisfaction temperature during the driving of the cooling unit, drive the cooling unit by a first load value that is lower than a second load value when the temperature of the refrigerating chamber is lower than the refrigerating satisfaction temperature.

* * * * *